United States Patent [19]

Lidén

[11] Patent Number: 4,565,150

[45] Date of Patent: Jan. 21, 1986

[54] OFFSHORE VESSEL

[75] Inventor: Hadar Lidén, Västra Frölunda, Sweden

[73] Assignee: Gotaverken Arendal AB, Sweden

[21] Appl. No.: 558,508

[22] Filed: Dec. 6, 1983

[30] Foreign Application Priority Data

Dec. 7, 1982 [SE] Sweden ..... 8206978

[51] Int. Cl.[4] ..... B63B 35/44

[52] U.S. Cl. ..... 114/265

[58] Field of Search ..... 114/264, 265, 61; 405/195–208; 52/152, 693, 695

[56] References Cited

U.S. PATENT DOCUMENTS

| | | | |
|---|---|---|---|
| 795,002 | 7/1905 | Nelson | 114/61 |
| 2,565,875 | 8/1951 | Musacchia | 52/695 |
| 4,232,625 | 11/1980 | Goren et al. | 114/265 |

*Primary Examiner*—Trygve M. Blix
*Assistant Examiner*—Jesûs D. Sotela
*Attorney, Agent, or Firm*—Cantor and Lessler

[57] ABSTRACT

In order to stay the columns in an offshore vessel of the type having two parallel pontoons and an operating platform carried thereby, also with respect to forces tending to displace the pontoons longitudinally in relation to each other, the columns located in the same transverse plane are interconnected by two transverse braces arranged in cruciform close to each other, but lacking direct connection.

2 Claims, 3 Drawing Figures

OFFSHORE VESSEL

BACKGROUND OF THE INVENTION

Various types of vessels and platforms are used in the offshore industry, either for stationary operation or designed to permit transfer between different fields.

Certain of the vessels of the last mentioned type are "semi-submersible", where an operating platform is carried by pontoons subdivided into ballast tanks, which makes it possible to raise the platform so the vessel during transfer (transit position) will move with the decks of the pontoons about at water level. When the vessel has reached the desired position the pontoons will be submerged to a position well below the water level, so the vessel will not noticeably suffer from the impact of wave movements.

The present invention refers to a semi-submersible offshore vessel of the kind having two parallel pontoons and an operating platform carried by the pontoons by means of at least two pairs of vertical columns. Usually the vessel is provided with two pairs of columns only, which then have to be very sturdy. The fact that the pontoons will be lowered to a considerable depth, while the operating platform still remains well above the water level means that the columns must be very high.

Earlier types of these vessels were provided with a considerable number of stays interconnecting the columns as well as running between the latter and the platform. By designing the latter as a strong box structure it has been possible to reduce the number of stays considerably. It has thus been proposed to use a single horizontal, transverse brace between two columns located side by side.

Heavy waves hitting the vessel obliquely in relation to a longitudinal middle plane will however tend to displace the pontoons lengthwise in relation to each other.

If the vessel is provided with four columns those may be regarded as located at the corners of a rectangular figure, where the pontoons form two sides, and the cross braces from the other two sides. Subjected to obliquely directed forces form the waves, the rectangular figure tends to be transferred into a rhombus, which will impose heavy strains upon the whole structure.

SUMMARY OF THE INVENTION

According to the invention it is now proposed that columns to opposite sides of a longitudinal middle plane through the vessel, and located in the same transverse plane, are interconnected by means of a pair of transverse braces, crossing each other as seen in a horizontal plane, running close to each other without any interconnection.

The problem, however, does not only concern a displacement in the longitudinal direction. Waves entering between the pontoons tend to force the pontoons away from each other sideways. It is believed that the cruciform braces, better than a single transverse brace, will break up the impact of waves between the pontoons.

The transverse braces are preferably tubular, the lowermost brace in each pair being located just above the water line, when the vessel is brought into normal transit position.

DESCRIPTION

Figure 1:
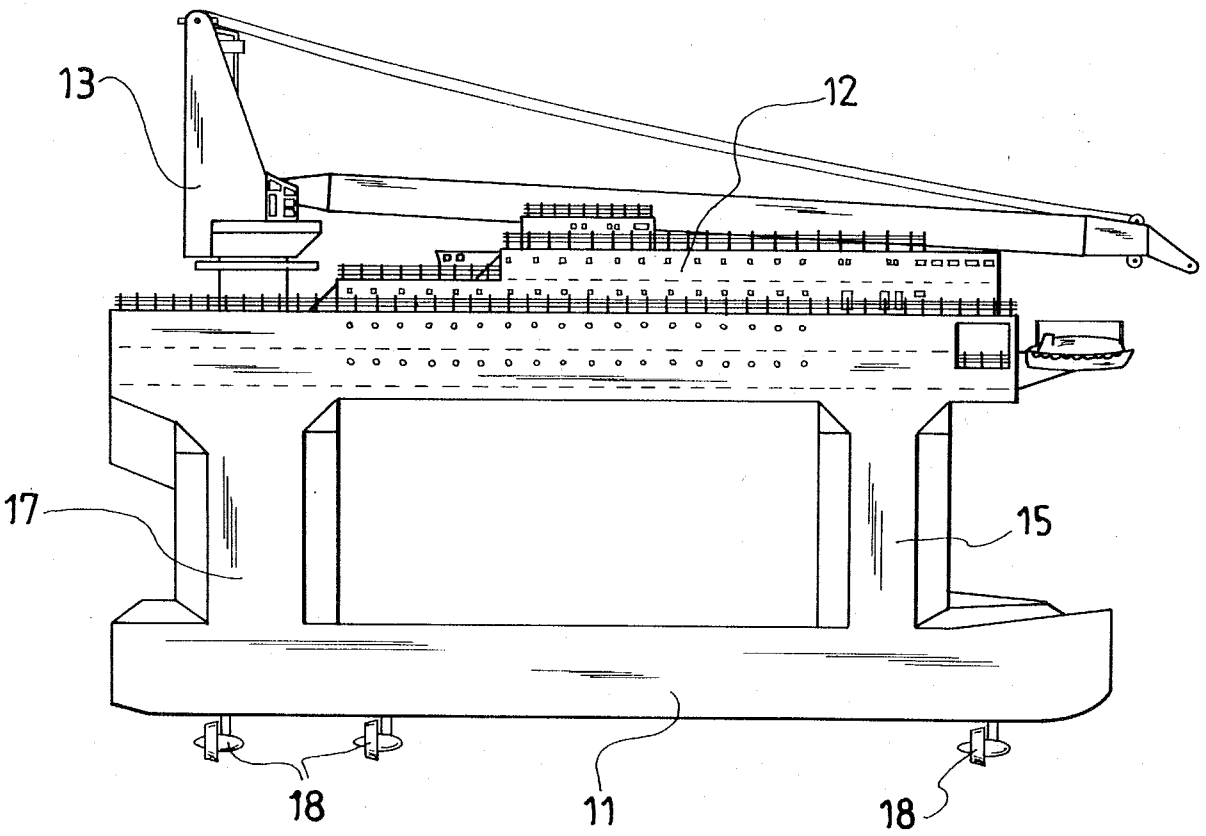
FIG. 1 shows an elevation of an offshore vessel according to the invention equipped for service and maintenance works.
Figure 2:
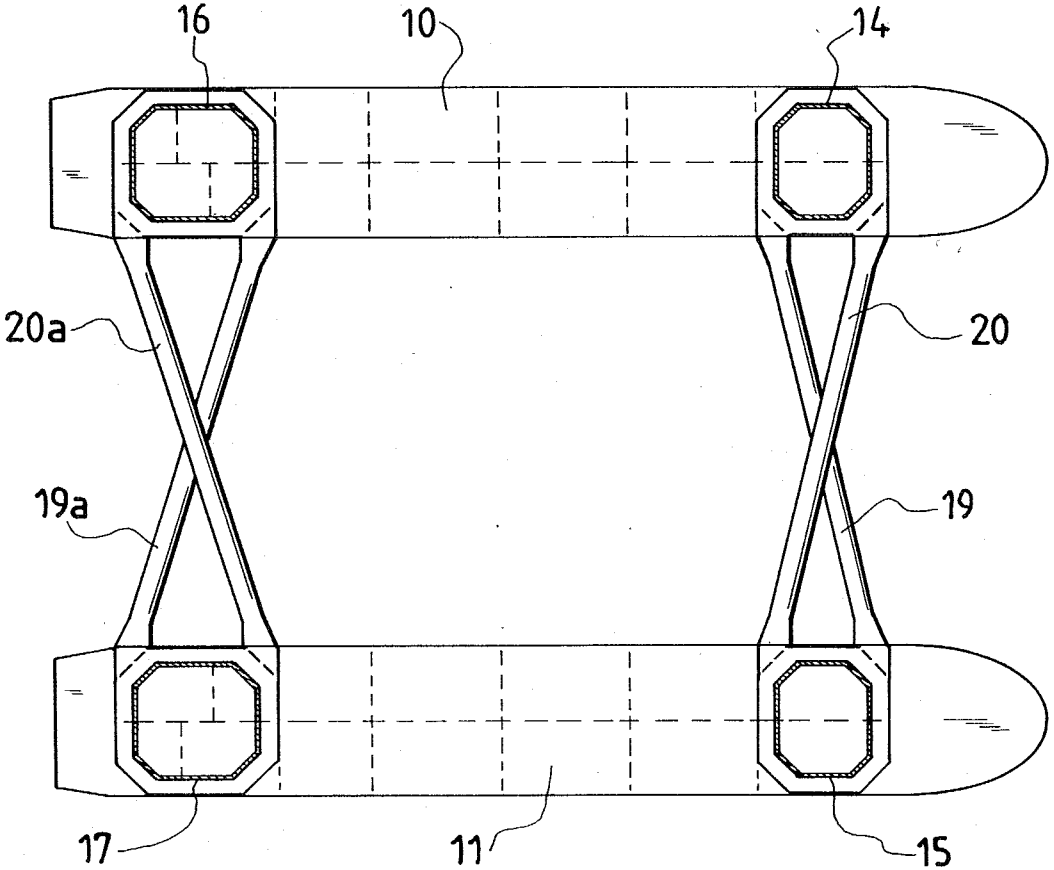
FIG. 2 shows a horizontal section through the columns of the vessel, just above the pontoons.
Figure 3:
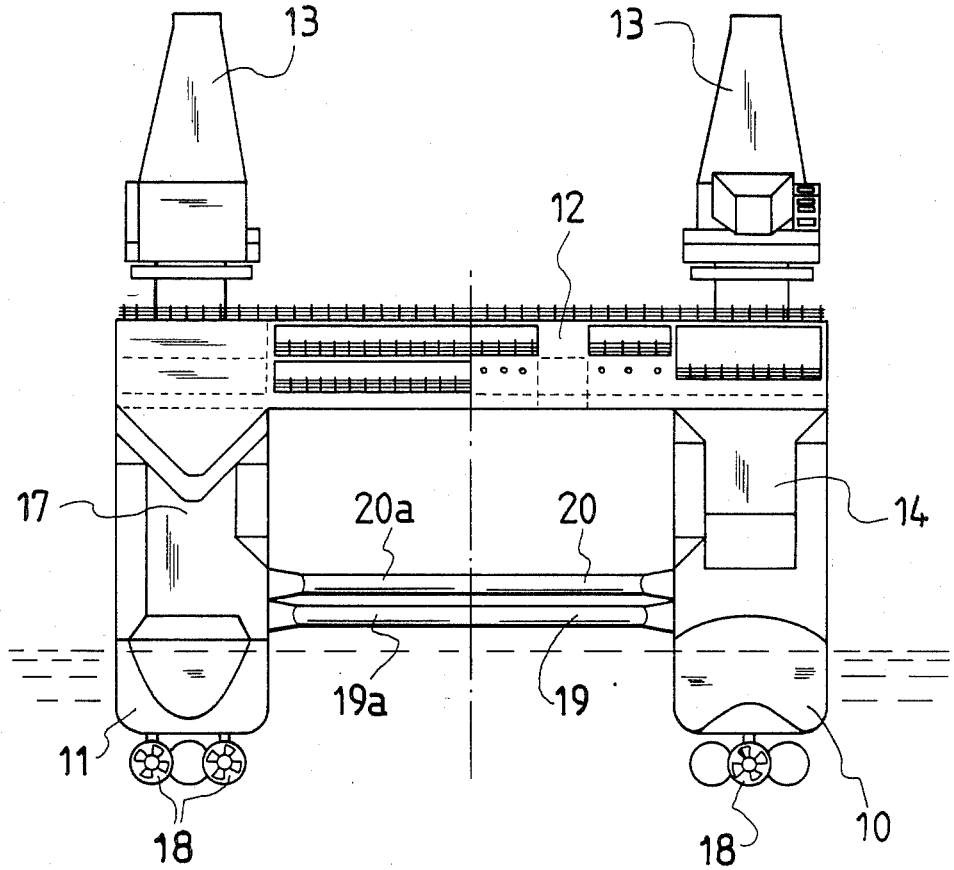
FIG. 3 shows end views of the vessel, the left hand half of the drawing showing the vessel as viewed from astern, and the right hand half showing the vessel as viewed from ahead.

The offshore vessel shown in the drawings is provided with two parallel pontoons 10, 11 and an operating platform 12. This is designed as a strong box structure and is subdivided into a number of tween decks providing locations for the crew, stores, workshops e.t.c. The vessel is provided with two heavy-lift cranes 13.

The operating platform 12 is carried by the pontoons by means of four sturdy columns 14, 15, 16, 17 arranged in pairs in relation to a longitudinal middle plane through the vessel.

The pontoons 10, 11, as well as the columns 14–17, enclose in a conventional manner tanks for ballast water as well as engine and pump rooms. Each pontoon is provided with three propellers 18, rotatable 360°, which beside propulsion also serve for steering the vessel during the journey, and positioning the same, when in operating position.

As is mentioned above, the pontoons, as well as the columns, may be subjected to heavy strains due to the influence of the waves, and it is essential that the columns are securely stayed in the transverse direction in such a manner that no tendencies to changes in lengthwise positioning occur.

Two braces 19 and 20 and **19*a*, 20*a*, respectively, are fitted between each pair of columns 14, 15 and 16, 17 respectively, located to each side of a longitudinal middle plane through the vessel, and in the same transverse plane. These braces will cross each other as viewed in a horizontal plane. The lower brace 19, 19*a* in each pair is located just above the water level, when the vessel is in transit position. The second brace 20, 20*a*** in each pair is located immediately above the first mentioned one, but does not have any connection therewith.

Each brace will thus take up a load independently of the other brace. An interconnection where the braces cross each other would mean a constructional complication, and would also disturb the flow of forces, as one brace may be subjected to compression while the other is supposed to take care of tension.

The braces are preferably formed as tubes, and as there is no connection between the tubes, these can easily be arranged for conveying pipes and conduits serving various functions in the pontoons. The vessel shown in the drawings is mainly a service unit, but the invention can be used for other kinds of offshore vessels as well, such as drilling and housing units, also vessels supported by three pairs of columns.

What we claim is:

1. In an offshore vessel of the kind having two parallel pontoons and an operating platform carried by said pontoons by means of at least two pairs of vertical columns, the improvement that columns to opposite sides of a longitudinal middle plane through the vessel, and located in the same transverse plane, are interconnected by means of a pair of transverse braces, crossing each other as seen in a horizontal plane, running close to each other without any interconnection.

2. An offshore vessel according to claim 1, in which said transverse braces are tubular, and the lowermost brace in each pair is located just above the water line, when the vessel is brought into normal transit position.

* * * * *